US008817057B2

(12) United States Patent
Yamaguchi

(10) Patent No.: US 8,817,057 B2
(45) Date of Patent: Aug. 26, 2014

(54) IMAGE ERASING DEVICE AND RELATED METHODS

(71) Applicant: Toshiba Tec Kabushiki Kaisha, Tokyo (JP)

(72) Inventor: Yoichi Yamaguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/839,487

(22) Filed: Mar. 15, 2013

(65) Prior Publication Data

US 2013/0242025 A1 Sep. 19, 2013

Related U.S. Application Data

(60) Provisional application No. 61/612,234, filed on Mar. 16, 2012.

(30) Foreign Application Priority Data

Dec. 21, 2012 (JP) ..... 2012-279877

(51) Int. Cl.
*B41M 7/00* (2006.01)

(52) U.S. Cl.
CPC ..... *B41M 7/0009* (2013.01); *B41M 7/009* (2013.01)
USPC ..... 347/179; 347/212

(58) Field of Classification Search
USPC ..... 347/171, 179, 218; 400/82, 188
See application file for complete search history.

(56) References Cited

U.S. PATENT DOCUMENTS

| | | | | |
|---|---|---|---|---|
| 2011/0074901 | A1* | 3/2011 | Tsuchihashi et al. | 347/179 |
| 2013/0002782 | A1* | 1/2013 | Kawaguchi et al. | 347/179 |
| 2013/0002783 | A1* | 1/2013 | Mizutani et al. | 347/179 |

FOREIGN PATENT DOCUMENTS

| | | | | |
|---|---|---|---|---|
| JP | 06-075487 | | 3/1994 | |
| JP | 06-171226 | * | 6/1994 | 503/227 |
| JP | 11-038807 | | 2/1999 | |
| JP | 2002-214957 | | 7/2002 | |

OTHER PUBLICATIONS

Computer-generated translation of JP 06-171226, published on Jun. 1994.*
U.S. Appl. No. 13/484,195, Takahiro Kawaguchi et al., filed May 30, 2012, 50 pages.
U.S. Appl. No. 13/528,542, Kikuo Mizutani et al., filed Jun. 20, 2012, 29 pages.

* cited by examiner

*Primary Examiner* — Huan Tran
(74) *Attorney, Agent, or Firm* — Patterson & Sheridan LLP

(57) ABSTRACT

An image erasing device includes first and second erasing sections. The first erasing section includes a first heating roller and a first pressing roller. The first heating roller and the first pressing roller are disposed on opposite sides of a conveying path. The first heating roller is configured to contact a first side of the sheet. The second erasing section is disposed downstream from the first erasing section, and includes a second heating roller and a second pressing roller. The second heating roller and the second pressing roller are disposed on opposite sides of the conveying path. The second heating roller is configured to contact a second side of the sheet. At least one of the second heating roller and the second pressing roller has a diameter smaller than one of a diameter of the first heating roller and a diameter of the first pressing roller.

20 Claims, 5 Drawing Sheets

IMAGE ERASING DEVICE AND RELATED METHODS

CROSS-REFERENCE TO RELATED APPLICATION

This application is based upon and claims the benefit of priority from U.S. Provisional Patent Application No. 61/612,234, filed on Mar. 16, 2012 and Japanese Patent Application No. 2012-279877, filed Dec. 21, 2012, the entire contents of which are incorporated herein by reference.

FIELD

Embodiments described herein relate to an image erasing device for erasing the image formed on a sheet by an image-forming apparatus.

BACKGROUND

In the related art, an MFP (multi-function peripheral) or other image-forming apparatus is employed to form an image on a sheet (paper sheet). To erase the image formed on the sheet so that the sheet is available for reuse, the image is printed on the sheet using an ink containing leuco dye or another erasable coloring agent.

The erasable coloring agent can be erased when heated to a high temperature. Consequently, when the sheet is to be reused, an erasing apparatus is employed to heat the sheet so that the image formed on the sheet is erased. In the erasing apparatus, a heating roller and a pressing roller are arranged facing each other with the conveying path of the sheet held between them. As the sheet is conveyed between the heating roller and the pressing roller, the sheet is heated so that the erasable coloring agent is erased. Here, the erasing section including a heating roller and a pressing roller is arranged on both the upstream side and downstream side along the conveying path of the sheet so that both sides of the sheet can be erased. Usually, the heating rollers and pressing rollers arranged on the upstream side and the downstream side have the same diameter.

The sheet conveyed in the erasing apparatus is heated by the upstream erasing section and then conveyed to the downstream erasing section. Consequently, for the downstream side, there is no need to have the same heat capacity as the upstream side. As a result, when the heating roller and pressing roller arranged on the upstream side and the rollers arranged on the downstream side have the same diameter and heating quantity, the arrangement of the downstream side becomes wastefully larger, and the power consumption is increased unnecessarily.

DETAILED DESCRIPTION

Figure 1:
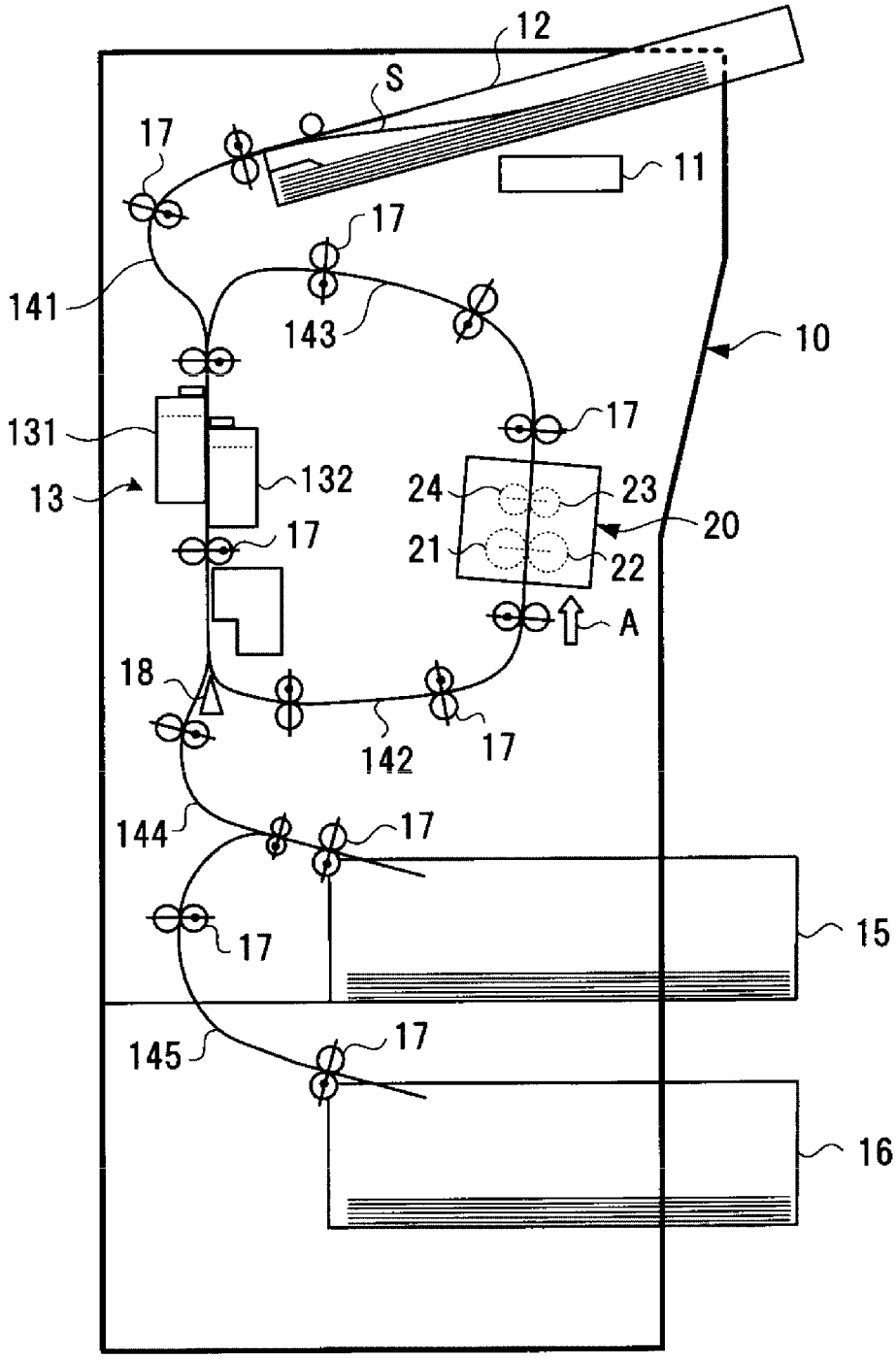
FIG. 1 is a diagram illustrating the overall arrangement of the image erasing device according to a first embodiment.

In general, a detailed description according to embodiments of the present disclosure will be explained with reference to figures. The same reference numbers for similar components are employed throughout the figures.

An image erasing device according to an embodiment comprises a first erasing section configured to heat and convey the sheet. The first erasing section comprises a first heating roller, and a first pressing roller, wherein the first heating roller and the first pressing roller are disposed on opposite sides of a conveying path, and the first heating roller is configured to contact a first side of the sheet. The image erasing device further comprises a second erasing section disposed downstream from the first erasing section in a paper conveying direction along the conveying path, the second erasing section configured to heat and convey the sheet. The second erasing section comprises a second heating roller, and a second pressing roller, wherein the second heating roller and the second pressing roller are disposed on opposite sides of the conveying path, and the second heating roller is configured to contact a second side of the sheet. In the image erasing device, at least one of the second heating roller and the second pressing roller has a diameter smaller than one of a diameter of the first heating roller and a diameter of the first pressing roller.

An image erasing device according to another embodiment comprises a paper-feeding section configured to feed a sheet, and a reading section configured to capture an image formed on the sheet. The image erasing device further comprises a first conveying path configured to convey the sheet from the paper-feeding section to the reading section, a second conveying path configured to convey the sheet from the reading section to an erasing section, a third conveying path configured to convey the sheet from the erasing section to the reading section, and a paper-discharging section that determines whether the sheet can be reused based on the captured image. The erasing section comprises a first heating roller, and a first pressing roller, wherein the first heating roller and the first pressing roller are disposed on opposite sides of a conveying path, and the first heating roller is configured to contact a first side of the sheet and to heat the sheet. The erasing section further comprises a second heating roller, and a second pressing roller, wherein the second heating roller and the second pressing roller are disposed on opposite sides of the conveying path downstream in a paper conveying direction from the first heating roller and the first pressing roller, and the second heating roller is configured to contact a second side of the sheet. In the image erasing device, at least one of the second heating roller and the second pressing roller has a diameter smaller than one of a diameter of the first heating roller and a diameter of the first pressing roller.

A method according to an embodiment comprises conveying a sheet having an image formed with an erasable coloring agent that can be erased when heated. The method further comprises heating the sheet in a first erasing section comprised of a first heating roller and a first pressing roller, wherein the first heating roller contacts a first surface of the sheet. The method further comprises heating the sheet in a second erasing section comprised of a second heating roller and a second pressing roller, wherein the second heating roller contacts a second surface of the sheet and at least one of the second heating roller and the second pressing roller has a diameter smaller than one of a diameter of the first heating roller and a diameter of the first pressing roller.

(First Embodiment)

FIG. 1 is a diagram illustrating the overall arrangement of an image erasing apparatus 10 according to the first embodiment. The image erasing apparatus 10 has an operation panel 11 that contains operation buttons and a display unit, a paper feeding section 12, a scanner 13 as the reading section, and an erasing section 20. In addition, the image erasing device 10 has a first conveying path 141, a second conveying path 142, a third conveying path 143, a fourth conveying path 144, a fifth conveying path 145, a first paper receiving tray 15, and a second paper receiving tray (rejection tray) 16.

Figure 5:
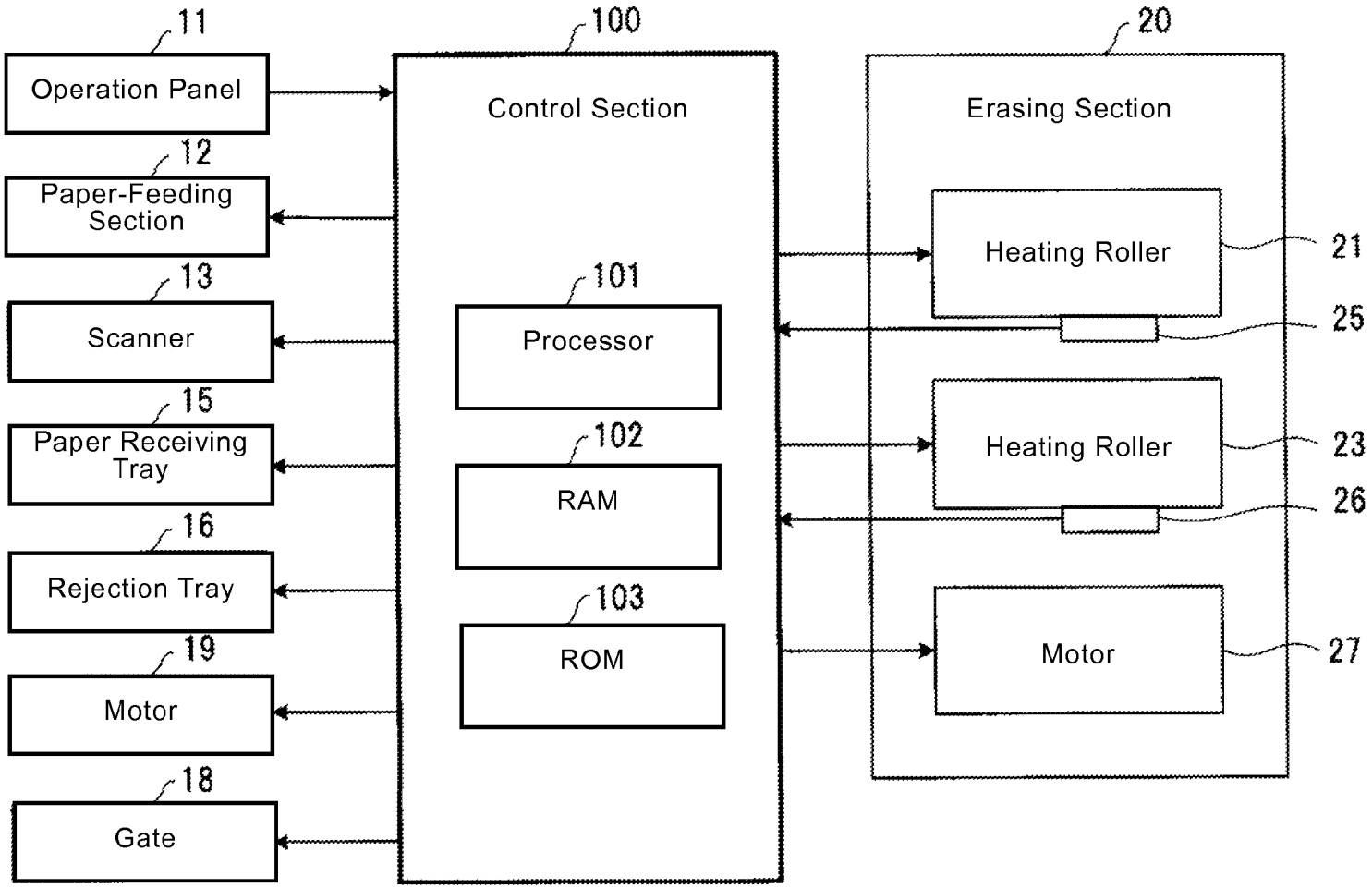
FIG. 5 is a block diagram illustrating a control system for the image erasing device, according to the embodiments.

Each of the conveying paths 141 to 145 has multiple conveying rollers 17 for conveying a sheet S. The multiple conveying rollers 17 are driven to rotate by a motor 19 (FIG. 5). To sort the sheets for conveying to the second conveying path 142 and the fourth conveying path 144, a gate 18 is arranged.

The first conveying path 141 conveys the sheet S fed from the paper-feeding section 12 to the scanner 13. The second conveying path 142 conveys the sheet S from the scanner 13 to the erasing section 20 in the direction indicated by the arrow A. The third conveying path 143 conveys the sheet S from the erasing section 20 to the scanner 13 again. The fourth conveying path 144 conveys the sheet S from the scanner 13 to the first paper receiving tray 15. The fifth conveying path 145 conveys the sheet S from the scanner 13 to the rejection tray 16. The first paper receiving tray 15 recovers the sheets available for reuse after an erasable image has been erased in the erasing section 20. The second paper receiving tray (rejection tray) 16 recovers the sheets that cannot be reused and holds such sheets to be discarded, usually for recycling.

Operation of the image erasing device 10 shown in FIG. 1 is now described.

First, the operation panel 11 is used to select the erasing and read modes for the sheet S. The sheet S is conveyed from the paper-feeding section 12 via the first conveying path 141 to the scanner 13 as the reading section. The image on the sheet S is scanned by the scanner 13 so that the image data is read before the image on the sheet S is erased. Then, a printing reuse rate of the sheet S is determined. The scanner 13 also reads a print state of the sheet S. The scanner 13 contains a first scanner 131 and a second scanner 132 for reading the two sides of the sheet S.

The image data read by the scanner 13 is stored in the memory section so that it can be read out again to re-create the image as needed. Based on the print state of the sheet S read by the scanner 13, if it is determined that the sheet S is torn or has wrinkles on it, the sheet S is guided to the fifth conveying path 145 so that it is conveyed to the rejection tray 16. Also, if the sheet S has a high printing reuse rate such that curling or the like is likely to take place during erasing processing, it is conveyed to the rejection tray 16. However, if the sheet S is free of tearing or wrinkles and has a low printing reuse rate, it is conveyed via the second conveying path 142 to the erasing section 20.

When the sheet S is conveyed to the erasing section 20 and passes through the erasing section 20, it is heated such that the image formed on the sheet S is erased. For example, in the erasing section 20, the sheet S is heated and pressed at a relatively high temperature of 180° C. to 200° C. so that the image on the sheet S is erased. Here, an erasable coloring agent is employed in forming the image on the sheet S so that the coloring agent can be erased when heated to the prescribed temperature. Consequently, it is possible to erase the sheet S as the sheet is conveyed at a preset conveying speed through the erasing section 20 that heats the sheet to the prescribed temperature.

After passing through the erasing section 20, the sheet S is then conveyed via the third conveying path 143 to the scanner 13 again. The scanner 13 checks whether the image formed by the erasable coloring agent has been sufficiently erased by scanning the sheet S and reading the print state again. The sheet S is then classified as reusable or rejected.

If the sheet S can be reused, it is conveyed via the fourth conveying path 144 to the first paper receiving tray 15. However, if the sheet S is found to have an image formed from a non-erasable coloring agent in its image region, to have a residual image remaining, to have a handwritten image remaining, or to be in a torn or wrinkled state, the sheet is conveyed via the fifth conveying path 145 to the rejection tray 16. The first paper receiving tray 15 and the rejection tray 16 together (but not exclusively) form a paper-discharging section.

Figure 2:
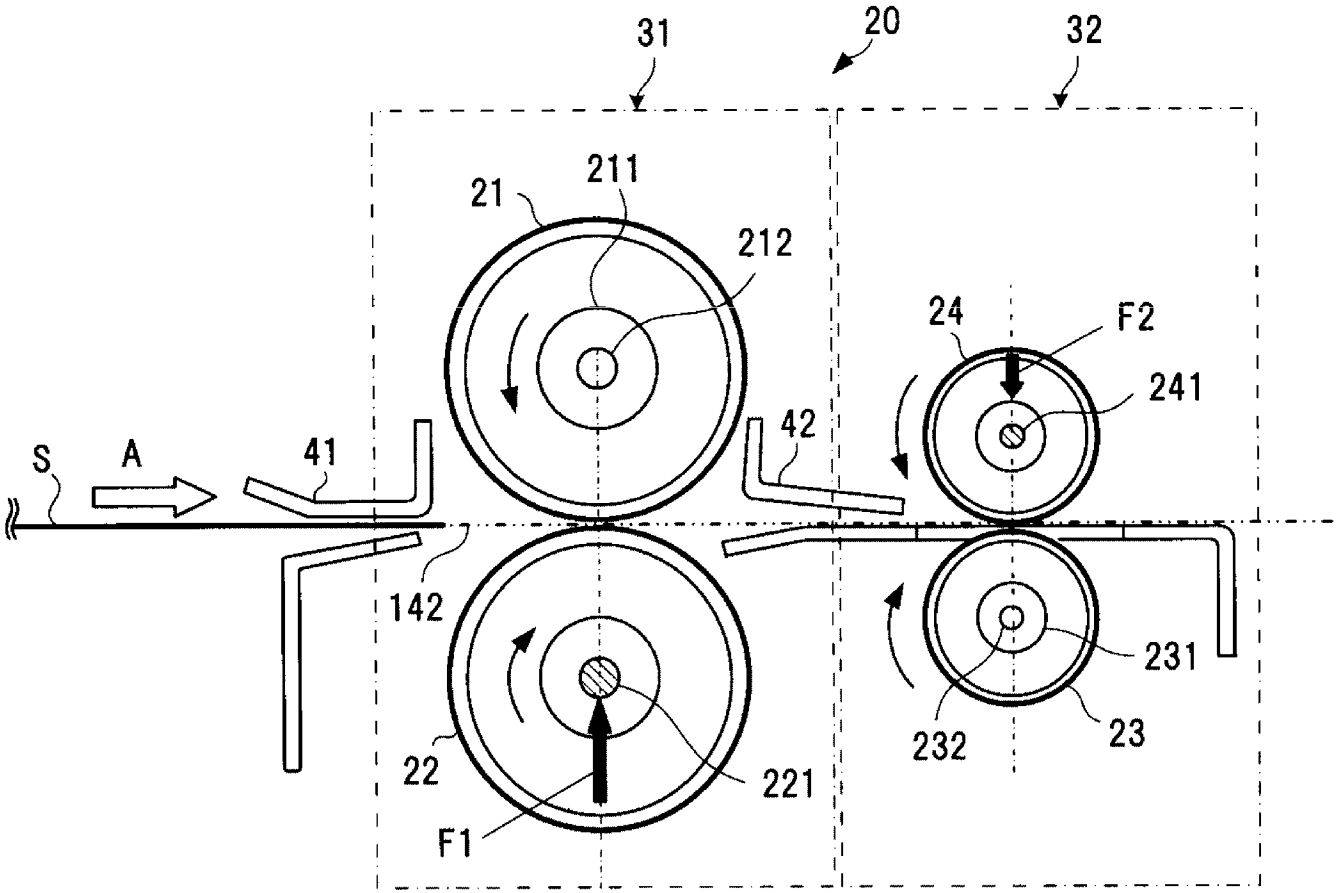
FIG. 2 is a diagram illustrating the erasing sections, according to the first embodiment.

As illustrated in FIG. 2, the erasing section 20 has a first erasing section 31 including a heating roller 21 and a pressing roller 22, and a second erasing section 32 including a heating roller 23 and a pressing roller 24. The sheet S is held between the heating roller 21 and the pressing roller 22 and then between the heating roller 23 and the pressing roller 24 as it is heated and conveyed through the erasing section 20. The heating rollers 21, 23 have internal heating sources, and they each have a temperature-detecting section on or near their outer surface. Lamps may be employed as the heating sources.

FIG. 2 is a diagram illustrating the arrangement of the first erasing section 31 and the second erasing section 32. As shown in FIG. 2, the first erasing section 31 includes the heating roller 21 and the pressing roller 22. The heating roller 21 and the pressing roller 22 are arranged facing each other with the second conveying path 142 indicated by the double-dot-dash line at the center between them. The heating roller 21 and the pressing roller 22 are arranged in a direction orthogonal to the conveying direction of the sheet S. The heating roller 21 contacts a first surface (front surface) of the sheet S. A force from a spring or the like is applied to a shaft 221 of the pressing roller 22, urging the pressing roller 22 in the direction towards the heating roller 21 indicated by the arrow F1. Thus, the heating roller 21 and pressing roller 22 are in contact with each other and under pressure.

The second erasing section 32 is arranged downstream from the first erasing section 31. The second erasing section 32 includes the heating roller 23 and the pressing roller 24. The heating roller 23 and the pressing roller 24 are arranged facing each other in a configuration inverted from that of the heating roller 21 and the pressing roller 22, with the second conveying path 142 at the center between them. That is, the heating roller 21 of the first erasing section 31 is on the first surface of the sheet S (i.e., the front surface), and the heating roller 23 of the second erasing section 32 is on the second surface (i.e., the back surface) of the sheet S. As the positions of the heating rollers 21, 23 on the upstream side and the downstream side are inverted from each other, so, too, are the positions of the pressing rollers 22, 24 inverted from each other on the upstream side and the downstream side.

The heating roller 23 and the pressing roller 24 have diameters smaller than those of the heating roller 21 and the pressing roller 22. The heating roller 23 and the pressing roller 24 are arranged in the direction orthogonal to the conveying direction of the sheet S. A force from a spring or the like is applied to a shaft 241 of the pressing roller 24, urging the pressing roller in the direction towards the heating roller 23 indicated by arrow F2.

When there is no sheet S, the heating roller 21 is in contact with the pressing roller 22 forming a first nip portion, and the heating roller 23 is in contact with the pressing roller 24 forming a second nip portion. The heating rollers 21, 23 are cylindrical in shape, and they include halogen lamps or other heating sources 211, 231 arranged inside them, respectively. By a motor 27 (FIG. 5), a shaft 212 of the heating roller 21 is rotated counter-clockwise, and a shaft 232 of the heating roller 23 is rotated clockwise. The heating rollers 21, 23 are rotated in the direction to convey the sheet S in the direction indicated by arrow A. As the heating rollers 21, 23 are rotated, the pressing rollers 22 and 24 are also rotated (slave rotation).

The rotation of the motor 27 is transmitted by gears and other transmission mechanisms to the heating roller 21 and the heating roller 23. Also, because the diameter of the heating roller 23 is smaller, the transmission mechanism has an arrangement that ensures a higher rotation velocity for the heating roller 23 than the heating roller 21 so that a sheet conveying velocity is appropriately controlled.

The guide plates 41, 42 are arranged to guide the sheet S to the first erasing section 31 and the second erasing section 32. The guide plates 41, 42 form a portion of the second conveying path 142.

In the arrangement shown in FIG. 2, the sheet S passes between the heating roller 21 and the pressing roller 22 and then between the heating roller 23 and the pressing roller 24. As a result, the image on the first surface (i.e., the front surface) is erased by the first erasing section 31. Because heat is also transferred to the second surface of the sheet S, the image formed on the second surface (i.e., the back surface) is also partially erased. Then, the residual image on the second surface of the sheet S is erased by the second erasing section 32.

Because the second surface of the sheet S is pre-heated by the first erasing section 31, the diameter of the heating roller 23 and the pressing roller 24 of the second erasing section 32 is smaller. Although the heat capacity of the second erasing section 32 is lower due to the smaller diameter, the image on the second surface of the sheet S can be fully erased.

Because the diameter of the heating roller 23 is smaller, the diameter of the heating source 231 is smaller, and its heat capacity is lower. Because the diameters of the heating roller 23 and the pressing roller 24 are smaller, the time for the sheet S to pass between the heating roller 23 and the pressing roller 24 becomes shorter. Likewise, because the width of the nip between the heating roller 23 and the pressing roller 24 is narrower, the quantity of heat for heating the sheet S can be smaller. Also, the narrower nip width can suppress curling of the sheet S.

According to the first embodiment, it is possible to have a lower heat capacity in the second erasing section 32 on the downstream side for the sheet S so that lower power consumption is needed for heating. Also, the size of the erasing section 20 can be made smaller.

(Second Embodiment)

Figure 3:
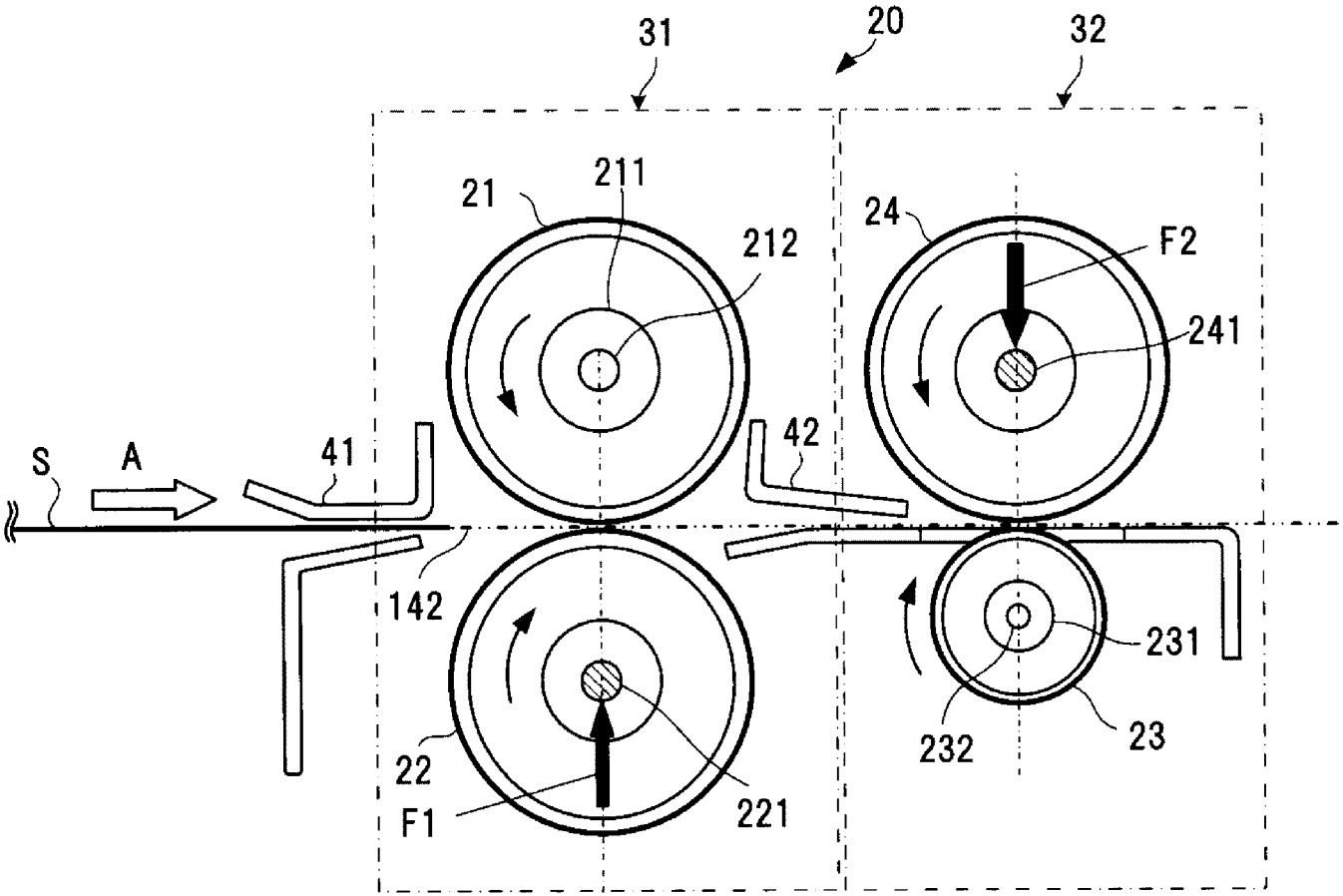
FIG. 3 is a diagram illustrating the erasing sections, according to a second embodiment.

FIG. 3 is a diagram illustrating the erasing section 20, according to the second embodiment.

As shown in FIG. 3, the first erasing section 31 includes the heating roller 21 and the pressing roller 22, and the second erasing section 32 includes the heating roller 23 and the pressing roller 24. The heating roller 21 contacts the first surface (front surface) of the sheet S, while the heating roller 23 contacts with the second surface (back surface) of the sheet S because these heating rollers are arranged inverted from each other on the upstream side and downstream side, respectively.

The features are the same as those in the first embodiment. However, as shown in FIG. 3, the diameter of the heating roller 23 is smaller than that of the pressing roller 22, while the pressing roller 22 and the pressing roller 24 have the same diameter. Forces indicated by the arrows F1, F2 are applied by springs or the like to the pressing rollers 22, 24 so that the pressing rollers 22, 24 are in contact with the heating rollers 21, 23, respectively.

In the arrangement shown in FIG. 3, the image on the first surface (i.e., the front surface) of the sheet S is erased by the first erasing section 31. The image on the second surface (i.e., the back surface) of the sheet S is erased by the second erasing section 32. Here, the second surface of the sheet S is pre-heated by the first erasing section 31 so that, although the diameter of the heating roller 23 of the second erasing section 32 is smaller and has a smaller heating capacity, the image on the second surface of the sheet S can still be fully erased. Because the diameter of the heating roller 23 is smaller, the diameter of the heating source 231 is also smaller, and the heat capacity can be lower. Also, because the width of the nip between the heating roller 23 and the pressing roller 24 is narrower, the heating time can be shortened and it is possible to suppress curling of the sheet S.

According to the second embodiment, it is possible to have a lower heat capacity for the second erasing section 32 on the downstream side for the sheet S, and it is possible to decrease the power consumption for heating.

(Third Embodiment)

Figure 4:
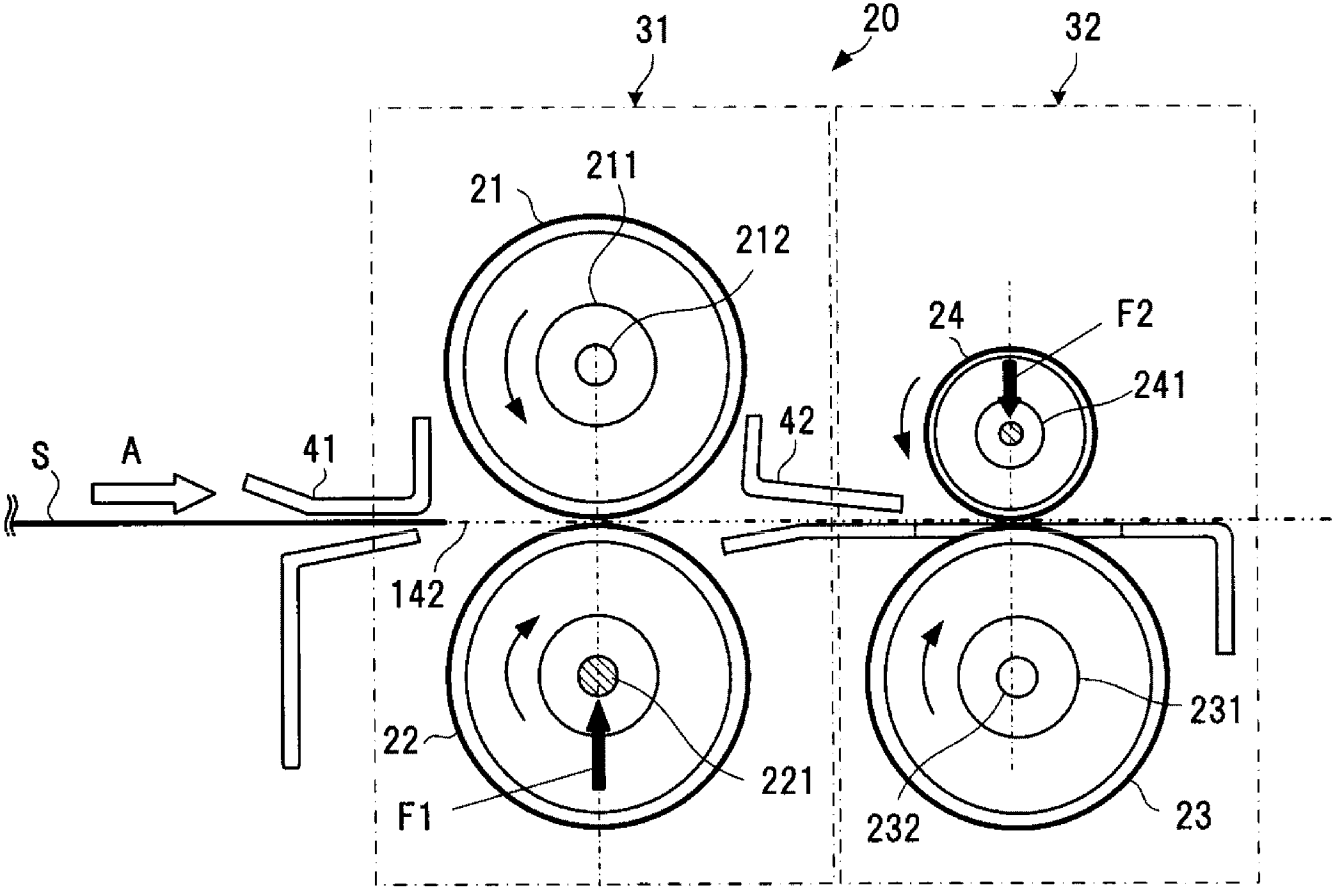
FIG. 4 is a diagram illustrating the erasing sections, according to a third embodiment.

FIG. 4 is a diagram illustrating the erasing section 20, according to the third embodiment.

As shown in FIG. 4, the first erasing section 31 includes the heating roller 21 and the pressing roller 22, and the second erasing section 32 includes the heating roller 23 and the pressing roller 24. The heating roller 21 contacts the first surface (front surface) of the sheet S, and the heating roller 23 contacts the second surface (back surface) of the sheet S because these rollers are arranged on the upstream side and the downstream side inverted from each other, respectively.

The features are the same as those of the first embodiment. However, as shown in FIG. 4, the pressing roller 24 has a smaller diameter than the pressing roller 22, while the heating roller 21 and the heating roller 23 have the same diameter. Forces indicated by the arrows F1, F2 are applied by springs or the like to the pressing rollers 22, 24 so that the pressing rollers 22, 24 are pressed towards the heating rollers 21, 23 so that they are in contact under pressure with their respective heating rollers.

According to the arrangement shown in FIG. 4, the image on the first surface (i.e., the front surface) of the sheet S is erased by the first erasing section 31, and the image on the second surface (i.e., the back surface) of the sheet S is erased by the second erasing section 32. Because the second surface of the sheet S is preheated by the first erasing section 31, the quantity of heat needed from the second erasing section 32 can be smaller while still fully erasing the image on the second surface of the sheet S still.

Because the diameter of the pressing roller 24 is smaller, the time for the sheet S to pass between the heating roller 23 and the pressing roller 24 becomes shorter. That is, because the width of the nip between the heating roller 23 and the pressing roller 24 is narrower, it is possible to shorten the heating time. Similarly, it is possible to use a smaller quantity of heat. Also, a narrower nip width can suppress curling of the sheet S. In addition, it is possible to decrease the temperature of the heating source 231 of the heating roller 23, thereby conserving power.

According to the third embodiment, it is possible to decrease the heat capacity of the second erasing section 32 on the downstream side so that it is possible to reduce the power consumption in heating. Also, because the heating roller 21 and the heating roller 23 have the same roller diameter, it is easy to control the rotation velocity driven by the motor 27 (through the arrangement of the transmission mechanism).

In the embodiments, the second erasing section 32 is arranged on the downstream side from the first erasing section 31. Here, the distance between the first erasing section 31 and the second erasing section 32 is selected to enable the sheet S with the shortest length to be held simultaneously between the heating roller 21 and the pressing roller 22 and between the heating roller 23 and the pressing roller 24. For example, the distance between the nips of the first erasing section 31 and the second erasing section 32 may be 60 mm.

The hardness values of the surfaces of the heating rollers 21, 23 are different from the hardness values of the surfaces of the pressing rollers 22, 24. The hardness of the surfaces of the heating rollers 21, 23 is selected to be higher than the hardness of the surfaces of the pressing roller 22, 24.

The image erasing device 10 in this embodiment may have an arrangement that allows it to be incorporated into the image-forming apparatus monolithically.

FIG. 5 is a block diagram illustrating the control system of the image erasing device 10 according to the embodiment. The image erasing device 10 includes a control section 100. The control section 100 includes a processor 101 (e.g., a CPU), a random access memory (RAM) 102, a read-only memory (ROM) 103, and the like.

The processor 101 executes the control program stored in the ROM 103. The RAM 102 is a main memory that functions as a working memory. The ROM 103 stores the control program and control data, and the like, for carrying out the operation of the image erasing device 10.

Under the instructions received from the operation panel 11, the control section 100 controls the paper-feeding section 12, the scanner 13, the paper-discharge section (paper receiving tray 15 and rejection tray 16), the rollers 17, and the gate 18. The operation panel 11 has, e.g., an erasure start button that generates instructions for erasure of the sheet S. The paper-feeding section 12 feeds the sheets with images formed on them, one sheet at a time, into the image erasing device 10. The scanner 13 reads and stores the image on the fed sheet. Also, the print state and printing reuse rate of the sheet is read. Then, based on the read result, the scanner 13 determines whether the sheet that has passed through the erasing section 20 can be reused.

In addition, the control section 100 controls the rotation of the motor 19 so that the conveying rollers 17 of the first to fifth conveying paths 141 to 145 are driven and the conveying of the sheet S is controlled. The gate 18 is also controlled so that the sheet S is conveyed to the selected conveying path. Then, the sheet that has been erased is conveyed into the paper-receiving tray 15, and the sheet that has not been erased or is torn or wrinkled is conveyed to the rejection tray 16 in a controlled manner.

The control section 100 also controls the on/off status of the heating roller 21 and the heating roller 23. Here, thermistors or other temperature-detecting elements 25, 26 are arranged in the heating roller 21 and the heating roller 23. Based on the temperature detection results from the temperature-detecting elements 25, 26, the control section 100 controls the temperature of the heating roller 21 and the heating roller 23 so that it is possible to prevent overheating. Also, the control section 100 controls the motor 27 that rotates the heating rollers 21, 23.

In the embodiments, the heat capacity required for erasing the sheet S can be decreased, and it is possible to decrease the power consumption when heating. Also, the size of the erasing section 20 can be made smaller.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing device comprising:

a first erasing section configured to heat and convey the sheet comprising:

a first heating roller, and a first pressing roller, wherein the first heating roller and the first pressing roller are disposed on opposite sides of a conveying path, and the first heating roller is configured to contact a first side of the sheet and provide a first heat output to the sheet; and a second erasing section disposed downstream from the first erasing section in a paper conveying direction along the conveying path, the second erasing section configured to heat and convey the sheet, the second erasing section comprising:

a second heating roller, and a second pressing roller, wherein the second heating roller and the second pressing roller are disposed on opposite sides of the conveying path, and the second heating roller is configured to contact a second side of the sheet and provide a second heat output to the sheet, the second heat output being less than the first heat output, wherein at least one of the second heating roller and the second pressing roller has a diameter smaller than one of a diameter of the first heating roller and a diameter of the first pressing roller.

2. The image erasing device according to claim 1, wherein a heat capacity of the second heating roller is lower than a heat capacity of the first heating roller.

3. The image erasing device according to claim 1, further comprising a control section configured to control a temperature of the first heating roller and a temperature of the second heating roller.

4. The image erasing device according to claim 3, further comprising:

a first temperature detector configured to detect the temperature of the first heating roller; and a second temperature detector configured to detect the temperature of the second heating roller, wherein the control section is configured to control the temperature of the first heating roller based on the detected temperature of the first heating roller and to control the temperature of the second heating roller based on the detected temperature of the second heating roller.

5. The image erasing device according to claim 3, wherein the controlled temperature of the second heating roller is lower than the controlled temperature of the first heating roller.

6. The image erasing device according to claim 3, wherein a power supplied to the first heating roller is greater than a power supplied to the second heating roller.

7. The image erasing device according to claim 1, further comprising a control section configured to determine whether the sheet which has been heated by the first erasing section and the second erasing section can be reused.

8. The image erasing device according to claim 7, further comprising an image reading section configured to capture an image on the sheet, wherein the control section determines whether the sheet can be reused based on the captured image.

9. An image erasing device comprising:

a paper-feeding section configured to feed a sheet;

a reading section configured to capture an image formed on the sheet;

a first conveying path configured to convey the sheet from the paper-feeding section to the reading section;

a second conveying path configured to convey the sheet from the reading section to an erasing section;

a third conveying path configured to convey the sheet from the erasing section to the reading section; and a paper-discharging section that determines whether the sheet can be reused based on the captured image; wherein:

the erasing section comprises:

a first heating roller, a first pressing roller, wherein the first heating roller and the first pressing roller are disposed on opposite sides of a conveying path, and the first heating roller is configured to contact a first side of the sheet and to provide a first heat output to the sheet, a second heating roller, and a second pressing roller, wherein the second heating roller and the second pressing roller are disposed on opposite sides of the conveying path downstream in a paper conveying direction from the first heating roller and the first pressing roller, and the second heating roller is configured to contact a second side of the sheet and to provide a second heat output to the sheet, the second heat output beinq less than the first heat output, wherein at least one of the second heating roller and the second pressing roller has a diameter smaller than one of a diameter of the first heating roller and a diameter of the first pressing roller.

10. The image erasing device according to claim 9, wherein a heat capacity of the second heating roller is lower than a heat capacity of the first heating roller.

11. The image erasing device according to claim 9, further comprising a control section configured to control a temperature of the first heating roller and a temperature of the second heating roller.

12. The image erasing device according to claim 11, further comprising:

a first temperature detector configured to detect the temperature of the first heating roller; and a second temperature detector configured to detect the temperature of the second heating roller, wherein the control section is configured to control the temperature of the first heating roller based on the detected temperature of the first heating roller and to control the temperature of the second heating roller based on the detected temperature of the second heating roller.

13. The image erasing device according to claim 11, wherein the controlled temperature of the second heating roller is lower than the controlled temperature of the first heating roller.

14. The image erasing device according to claim 11, wherein a power supplied to the first heating roller is greater than a power supplied to the second heating roller.

15. A method for erasing an image comprising:

conveying a sheet having an image formed with an erasable coloring agent that can be erased when heated;

heating the sheet in a first erasing section comprised of a first heating roller and a first pressing roller, wherein the first heating roller contacts a first surface of the sheet and provides a first heat output to the sheet; and heating the sheet in a second erasing section comprised of a second heating roller and a second pressing roller, wherein the second heating roller contacts a second surface of the sheet and to provide a second heat output to the sheet, the second heat output being less than the first heat output, and at least one of the second heating roller and the second pressing roller has a diameter smaller than one of a diameter of the first heating roller and a diameter of the first pressing roller.

16. The method for erasing an image according to claim 15, wherein a heat capacity of the second heating roller is lower than a heat capacity of the first heating roller.

17. The method for erasing an image according to claim 15, further comprising:

controlling a temperature of the first heating roller; and controlling a temperature of the second heating roller.

18. The method for erasing an image according to claim 17, further comprising:

detecting the temperature of the first heating roller; and detecting the temperature of the second heating roller; wherein controlling the temperature of the first heating roller based on the detected temperature of the first heating roller and controlling the temperature of the second heating roller based on the detected temperature of the second heating roller.

19. The method for erasing an image according to claim 15, further comprising:

supplying a power to the first heating roller; and supplying a power to the second heating roller, wherein the power supplied to the second heating roller is less than the power supplied to the first heating roller.

20. The method for erasing an image according to claim 15, further comprising:

capturing an image of the sheet after heating the sheet in the first heating section and the second heating section; and determining whether the sheet can be reused based on the captured image.

* * * * *